US006997725B2

(12) United States Patent
Stella et al.

(10) Patent No.: US 6,997,725 B2
(45) Date of Patent: Feb. 14, 2006

(54) ELECTRIC CONNECTOR

(75) Inventors: Gianni Stella, Turin (IT); Rocco Pizzarelli, Settimo Torinese (IT); Fausto Girard, Turin (IT)

(73) Assignee: FCI, Versailles (FR)

( * ) Notice: Subject to any disclaimer, the term of this patent is extended or adjusted under 35 U.S.C. 154(b) by 0 days.

(21) Appl. No.: 10/472,926

(22) PCT Filed: Mar. 26, 2002

(86) PCT No.: PCT/EP02/03394

§ 371 (c)(1),
(2), (4) Date: Mar. 29, 2004

(87) PCT Pub. No.: WO02/078126

PCT Pub. Date: Oct. 3, 2002

(65) Prior Publication Data

US 2005/0064749 A1 Mar. 24, 2005

(30) Foreign Application Priority Data

Mar. 27, 2001 (IT) ..... TO2001A0290

(51) Int. Cl.
*H01R 13/62* (2006.01)

(52) U.S. Cl. ..... 439/157; 439/372

(58) Field of Classification Search ..... 439/152, 439/157, 159, 160, 259, 266, 347, 372
See application file for complete search history.

(56) References Cited

U.S. PATENT DOCUMENTS 5,489,224 A 2/1996 Schwarz ..... 439/752
5,876,226 A * 3/1999 Tsukakoshi et al. ..... 439/157
5,928,011 A 7/1999 Flask et al. ..... 439/157
5,928,012 A * 7/1999 Kitamura ..... 439/157
6,244,880 B1 * 6/2001 Fukase et al. ..... 439/157
6,254,407 B1 * 7/2001 Burns ..... 439/157
6,382,992 B1 * 5/2002 Bouchan et al. ..... 439/157
6,422,882 B1 * 7/2002 May et al. ..... 439/157
6,475,004 B1 * 11/2002 Shuey et al. ..... 439/157

FOREIGN PATENT DOCUMENTS

EP 0991145 A2 4/2000
EP 1005112 A2 5/2000
EP 0991145 A3 10/2000
EP 1005112 A3 11/2000

* cited by examiner

*Primary Examiner*—Thanh-Tam Le
(74) *Attorney, Agent, or Firm*—Harrington & Smith, LLP

(57) ABSTRACT

An electric connector (2, 2') having an insulating casing (4) defining a number of cavities for housing respective electric terminals and having axes parallel to a first direction (A) in which the connector (2, 2') is coupled to a complementary connector (3); a slide (16) fitted to the casing (4) to slide in a second direction (B) perpendicular to the first direction (A), and having cam-type first engaging members (22) for receiving respective second engaging members (23) on the complementary connector (3) to produce a relative coupling movement of the connectors (2, 2'; 3) in the first direction (A) when the slide (16) is moved in the second direction (B) into a fully assembled position with respect to the casing (4); and retaining means (40, 41, 62) for keeping the slide (16) partly connected to the casing (4); the retaining means (40, 41, 62) being selectively deactivated when coupling the connector (2, 2') to the complementary connector (3).

22 Claims, 4 Drawing Sheets

ELECTRIC CONNECTOR

TECHNICAL FIELD

The present invention relates to an electric connector, and particularly, though not exclusively, to an electric plug connector which mates with a complementary electric socket connector to form a multiple-way electric connecting unit of the type used to connect an electric system to an electronic central control unit.

BACKGROUND ART

Connecting units of the above type are known in which the connectors comprise respective insulating casings defining respective numbers of cavities for housing respective connectable male and female electric terminals.

Such units normally comprise a lever-and-slide coupling device, which is operated manually when the plug and socket connectors are engaged to couple the connectors with a minimum amount of effort.

The lever-and-slide coupling device substantially comprises a slide fitted to slide inside the plug connector casing in a direction perpendicular to the coupling direction of the connectors; and an actuating lever hinged to the plug connector casing and connected to the slide.

In a fairly common embodiment, the slide is C-shaped and defined by an end wall perpendicular to the sliding direction, and by two lateral walls extending perpendicularly from respective opposite end edges of the end wall, and which slide along respective lateral walls of the plug connector casing. Each lateral wall of the slide has a number of cam grooves for receiving respective external pins on the socket connector, and for producing a relative engaging movement of the plug and socket connectors in the coupling direction when the slide is moved in the sliding direction.

The slide is normally retained, by releasable retaining means, e.g. click-on retaining members, in a preassembly position partly inserted inside the plug connector casing, and is moved into a fully inserted position inside the casing by rotating the actuating lever from a raised to a lowered position about its hinge axis.

To function properly, the releasable retaining means must be sized and designed to ensure a given load by which to retain the slide inside the casing.

The load, however, may not be sufficient to prevent the slide from being inserted accidentally inside the plug connector casing, in the event the plug connector is knocked, dropped, etc. before being coupled to the complementary connector. In which case, the slide must be reset to the preassembly position before the connectors are coupled, thus complicating assembly of the connecting unit.

By way of a solution to the problem, the load exerted by the retaining means could be increased, though this would also mean a corresponding increase in the force required on the actuating lever to couple the connectors, thus impairing the function for which the lever-and-slide coupling device was designed, i.e. to permit coupling of the connectors with a minimum amount of effort.

DISCLOSURE OF INVENTION

It is an object of the present invention to provide an electric connector designed to provide a simple, reliable solution to the aforementioned drawbacks typically associated with known connectors.

According to the present invention, there is provided an electric connector as claimed in claim 1.

BRIEF DESCRIPTION OF THE DRAWINGS

Two preferred, non-limiting embodiments of the present invention will be described by way of example with reference to the accompanying drawings, in which.

BEST MODE FOR CARRYING OUT THE INVENTION

Figure 1:
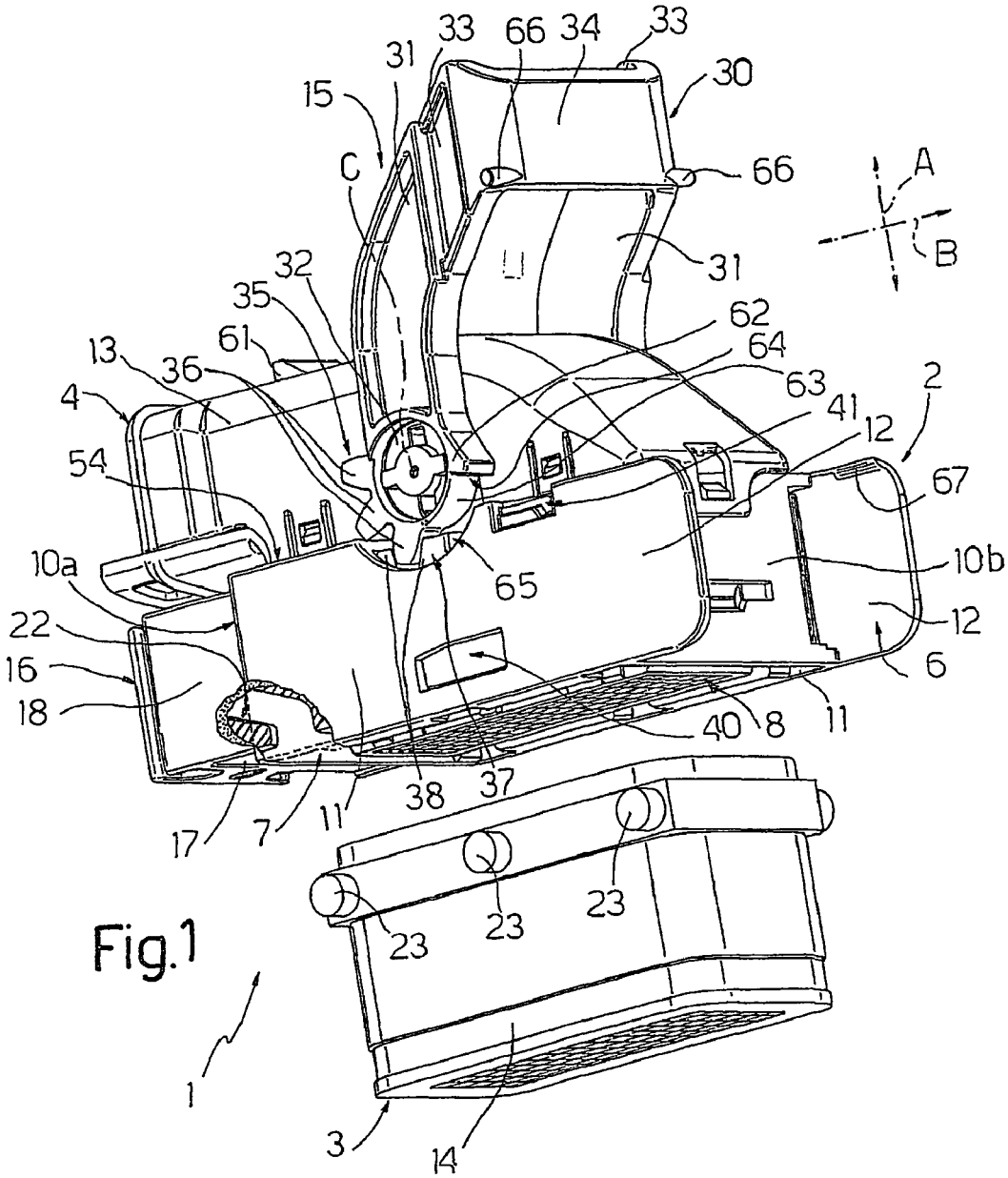
FIG. 1 shows an exploded view in perspective, with parts removed for clarity, of an electric connecting unit defined by an electric plug connector in accordance with the present invention, and by a complementary electric socket connector.

Number 1 in FIG. 1 indicates as a whole a multiple-way electric connecting unit, in particular for connecting an electronic central control unit (not shown) to a vehicle electric system (not shown).

Unit 1 comprises a first plug connector 2 and a second socket connector 3, which are coupled in a direction A.

Connector 2 according to the present invention comprises an insulating casing 4 made of plastic material and defining a number of cavities (not shown in the accompanying drawings) having axes parallel to direction A and for housing respective known female electric terminals (not shown) retained in known manner inside the cavities and connected to respective known electric cables (not shown).

Casing 4 comprises a hollow, substantially parallelepiped-shaped main body 6 defining an end opening 7 for the insertion of connector 3, and housing a substantially parallelepiped-shaped block 8 for supporting the female terminals and in which said cavities are formed.

More specifically, main body 6 is defined by a front and rear end wall 10*a*, 10*b*, and by two lateral walls 11 perpendicular to end walls 10*a*, 10*b* and defining, with end walls 10*a*, 10*b*, opening 7 for receiving connector 3.

As shown in FIG. 1, respective end portions 12 of lateral walls 11 of main body 6 project outwards of block 8 from end wall 10*b*.

Casing 4 also comprises an outer shell 13 connected to main body 6 on the opposite side to opening 7, and through which extend the electric cables connected to the female terminals carried by block 8.

Connector 3—described herein only as pertinent to the present invention—comprises a hollow, substantially parallelepiped-shaped insulating casing 14 conveniently formed in one piece with the outer casing (not shown) of the electronic central control unit, and housing a number of known male terminals (not shown) extending parallel to direction A and connected to respective known electric cables (not shown). Casing 14 defines a seat for receiving block 8 of connector 2, and in which project respective contact portions of the male terminals.

Unit 1 also comprises a lever-and-slide coupling device 15 by which to couple connectors 2 and 3 with a minimum amount of effort.

Coupling device 15 comprises a slide 16 which is movable inside and with respect to casing 4 in a direction B perpendicular to direction A and to end walls 10*a*, 10*b* of main body 6. Slide 16 (FIG. 4) is substantially C-shaped, and comprises an end wall 17 perpendicular to direction B; and two lateral walls 18 extending perpendicularly from respective opposite lateral edges of end wall 17 and parallel to directions A and B. Lateral walls 18 of slide 16 extend through respective lateral end openings (not shown) in end wall 10*a*, and slide between block 8 and respective opposite lateral walls 11 of main body 6 of casing 4. Main body 6, block 8, and lateral walls 18 of slide 16 together define a seat for receiving casing 14 of connector 3 and therefore defining a coupling region of connectors 2 and 3.

Each lateral wall 18 has a number of (in the example shown, three) cam grooves 22 (FIG. 4) which cooperate with respective external pins 23 on casing 14 to produce a relative engaging movement of connectors 2 and 3 in direction A when slide 16 is moved inwards of casing 4 in direction B. The form of grooves 22 is known from EP-A-363804, and is therefore only described briefly.

Figure 4:
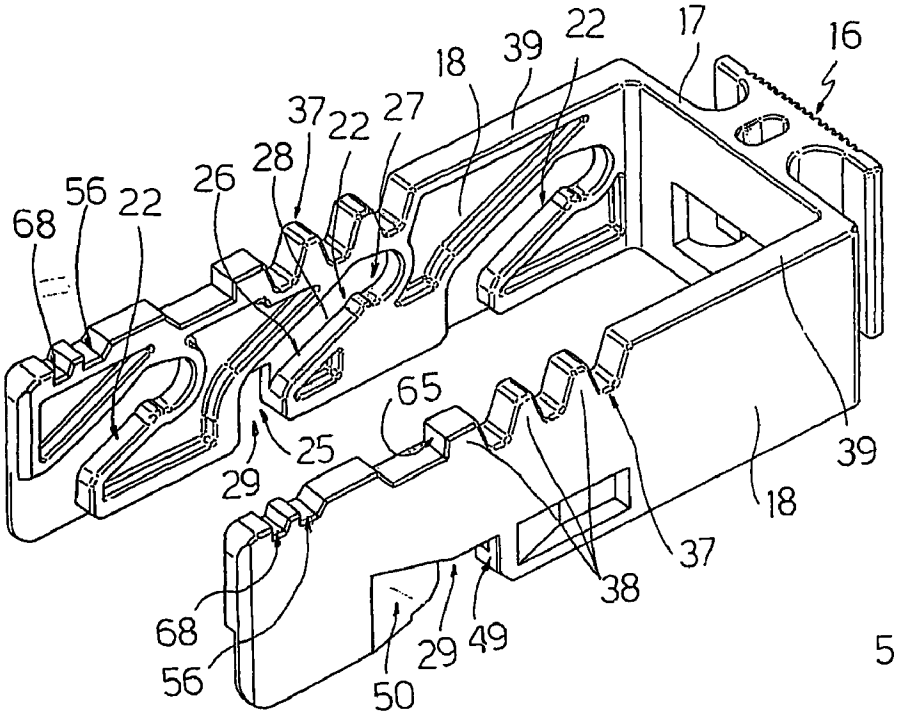
FIG. 4 shows a larger-scale view in perspective of a slide of the FIG. 1 plug connector.

With reference to FIG. 4, each groove 22 comprises an inlet portion 25 for respective pin 23, extending parallel to direction A and located close to opening 7; an intermediate portion 26 sloping with respect to directions A and B; and an end portion 27 parallel to direction B and defining a stop surface for pin 23. Grooves 22 of each lateral wall 18 are open on the side facing the other lateral wall 18, and are closed on the opposite side by an end surface 28; and, as shown in FIG. 4, the end surface 28 of the intermediate groove 22 of each lateral wall 18 of slide 16 defines, at inlet portion 25, a through opening 29 for the purpose explained later on.

Coupling device 15 also comprises an actuating lever 30, which is hinged to casing 4 about an axis C perpendicular to directions A and B, and which engages lateral walls 18 of slide 16 so that rotation of lever 30 about axis C moves slide 16 in direction B and, by virtue of pins 23 engaging grooves 22, causes relative engagement of connectors 2 and 3 and the respective terminals in direction A.

Layer 30 is defined by two contoured arms 31 having first end portions 32 hinged about axis C on opposite outer sides of shell 13 of casing 4, and second end portions 33 joined by a cross member 34.

Each end portion 32 is cylindrical about axis C, and defines, on one side of the span of relative arm 31, a toothed sector 35 defined, in the example shown, by three teeth 36, and which meshes with a rack 37, also defined by three teeth 38 and formed in an intermediate portion of an end edge 39, adjacent to shell 13, of a relative lateral wall 18 of slide 16.

To couple connectors 2 and 3, lever 30 is rotated, by pushing cross member 34 towards end wall 17 of slide 16 (anticlockwise in FIG. 1), from a raised position (FIG. 1) corresponding to a predetermined withdrawal of slide 16 from casing 4, to a first lowered closed position on casing 4 corresponding to full insertion or full assembly of lateral walls 18 of slide 16 inside casing 4, and a final coupled position of connectors 2 and 3.

Connector 2 also comprises first and second releasable one-way retaining means 40, 41 interposed between slide 16 and main body 6, and acting in opposite ways in direction B to retain slide 16 in a first partly assembled position in which it is withdrawn from casing 4 to receive connector 3 and lever 30 in the raised position (FIG. 1).

Figure 5:
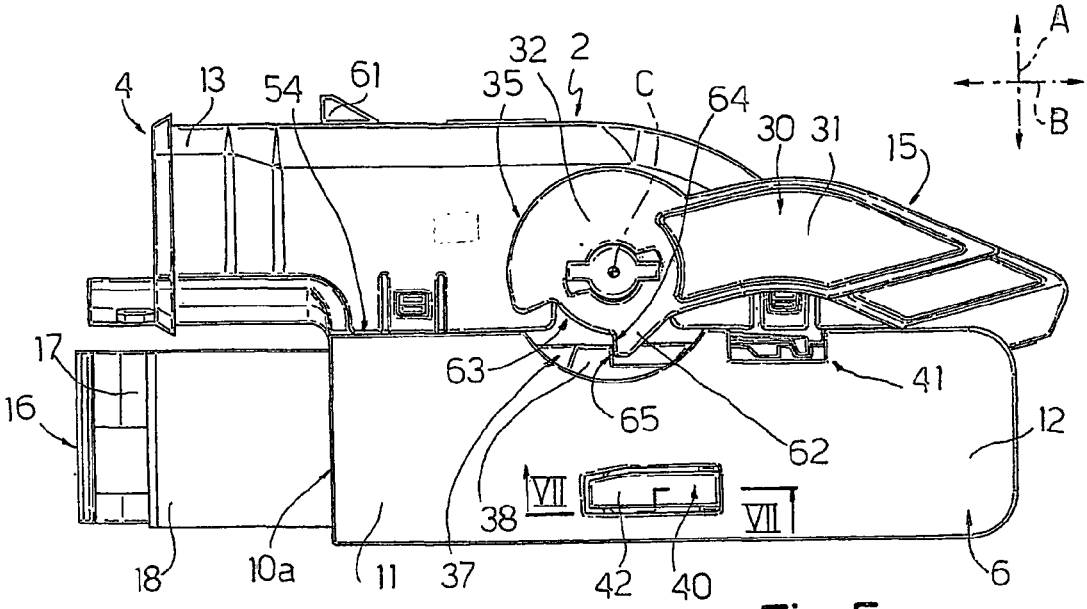
FIG. 5 shows a larger-scale side view of the FIG. 1 electric plug connector in a different configuration.
Figure 7:
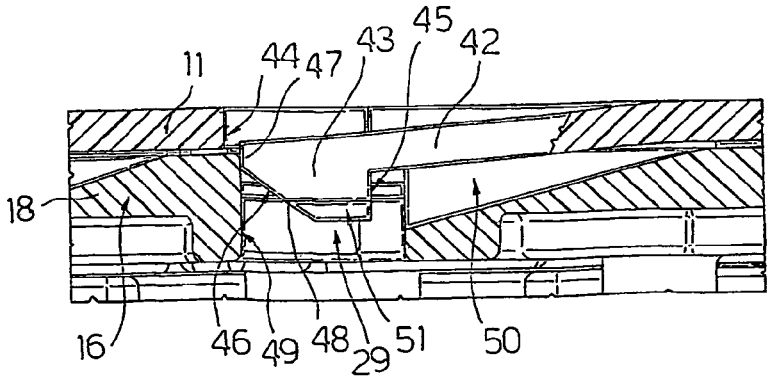
FIG. 7 shows a larger-scale section along line VII—VII in FIG. 5.

With reference to FIGS. 1, 5 and 7, one-way retaining means 40 comprise two elastically flexible lances 42 projecting integrally from respective lateral walls 11 of main body 6 of casing 4, and having respective end teeth 43 engaging openings 29 in relative lateral walls 18 of slide 16 and, therefore, inlet portions 25 of intermediate grooves 22 of slide 16.

Lances 42 project inwards of main body 6 to prevent, by means of teeth 43, further insertion of slide 16 inside main body 6 (FIG. 7), and, when connector 3 is inserted correctly inside the seat on connector 2, can be set to a flexed release configuration to release openings 29 and allow slide 16 to be moved in direction B into the fully assembled positioned.

More specifically, each lance 42 is defined by a substantially rectangular strip of material only joined to respective lateral wall 11 along the end edge facing respective end portion 12, and engaging a respective through opening 44 formed in lateral wall 11.

Each lance 42 is set to the flexed configuration by interaction with the pin 23 on connector 3 engaging the relative intermediate groove 22 on slide 16.

Teeth 43 are formed on the free ends of respective lances 42, and have, facing end portions 12 of lateral walls 11, straight rear edges 45 perpendicular to direction B, and, on the opposite side, contoured front edges 46. More specifically, as of the surface of relative lance 42 facing outwards of main body 6, edge 46 of each tooth 43 is defined by a straight first portion 47 parallel to edge 45, and by an oblique second portion 48 defining a section of tooth 43 increasing towards edge 45.

Openings 29 (FIGS. 4 and 7) are defined, towards end wall 17 of slide 16, by straight edges 49 perpendicular to direction B, and, on the opposite side, by ramp-shaped edges 50 for easing lateral walls 18 of slide 16 along teeth 43 into the fully assembled position when lances 42 are in the flexed configuration.

More specifically, when each lance 42 is in the nonflexed configuration (FIG. 7), portion 47 of edge 46 of relative tooth 43 cooperates with edge 49 of opening 29 of relative lateral wall 18 of slide 16 to prevent slide 16 from moving into the fully assembled position; and, conversely, when lances 42 are in the flexed configuration, each opening 29 is engaged by the part of relative tooth 43 defined by oblique portion 48 of edge 46, to enable slide 16 to move into the fully assembled position inside main body 6 of casing 4.

Once inserted inside inlet portions 25 of relative intermediate grooves 22, pins 23 act on teeth 43 of relative lances 42 to rotate lances 42 outwards of casing 4 and so release from openings 29 the parts of teeth 43 defined by portions 47 of edges 46.

To assist flexing of lances 42 by pins 23 on connector 3, teeth 43 are defined, towards pins 23, by diverging oblique surfaces 51.

Figure 3:
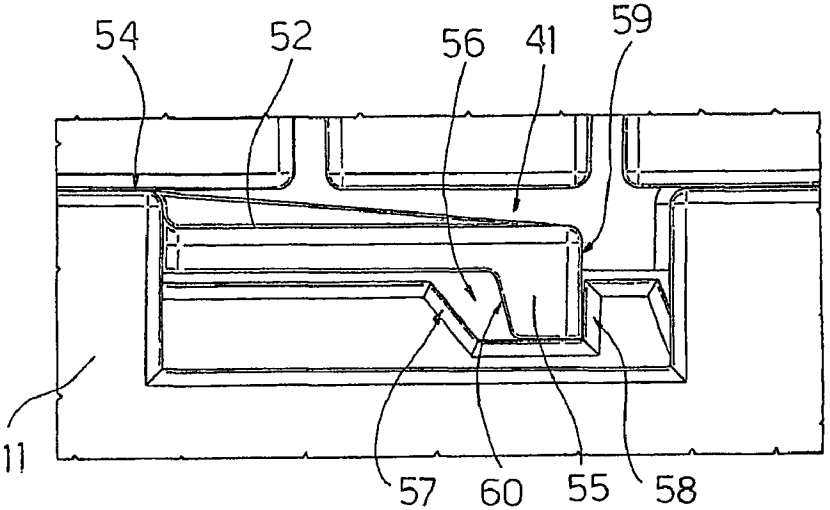
FIG. 3 shows a larger-scale view in perspective of a further detail of the FIG. 1 electric plug connector.

With reference to FIGS. 1, 3 and 4, one-way retaining means 41 comprise two elastically flexible lances 52 projecting integrally from a wall 54 of main body 6, from which shell 13 extends, located on opposite sides of shell 13, and having respective end teeth 55 which click inside respective seats 56 formed in edges 39 of lateral walls 18 of slide 16 to prevent withdrawal of slide 16 from main body 6.

More specifically, each seat 56 (FIG. 3) is defined, towards end wall 17, by a ramp-shaped edge 57 for enabling relative lateral wall 18 of slide 16 to slide in direction B along tooth 55 of relative lance 52 into the fully assembled position, and, on the opposite side, by a straight edge 58 perpendicular to direction B and for preventing withdrawal of slide 16 from main body 6.

Each tooth 55 is defined by a straight edge 59 perpendicular to direction B and which cooperates with edge 58 of relative seat 56, and by a slightly oblique opposite edge 60 which cooperates with edge 57 of seat 56.

The fully assembled position of slide 16 is defined by cross member 34 of lever 30 clicking on to a releasable retaining member 61—in the example shown, an elastically flexible lance similar to lances 42 and 52—extending integrally from the opposite side of shell 13 to that connected to main body 6.

Lever 30 may advantageously be rotated about axis C from the raised position to a second closed or deactivated position on casing 4 (FIG. 5), in which it is retained between end portions 12 of lateral walls 11 of main body 6, and keeps slide 16 in a second partly assembled position or a position of maximum withdrawal from casing 4.

More specifically, end portion 32 of each arm 31 of lever 30 has a further tooth 62 which, in the second closed position of lever 30, defines an additional stop preventing slide 16 from moving in direction B into the fully assembled position. On end portion 32 of each arm 31 of lever 30, a cylindrical free portion 63 is formed between tooth 62 and sector gear 35 to permit disconnection of lever 30 and slide 16 when lever 30 is rotated from the raised position to the second closed position.

Each tooth 62 has a profile in the form of a right trapezium, and is defined, towards relative free portion 63, by a straight edge 64 substantially radial with respect to axis C and which cooperates with a corresponding edge 65, perpendicular to direction B, of the end tooth 38 of relative rack 37 located close to the free end of relative lateral wall 18 of slide 16.

The second closed position of lever 30 on casing 4 is defined by two pins 66, projecting laterally from opposite sides of cross member 34, clicking on to respective projections 67 formed on end portions 12 of lateral walls 11 of main body 6.

More specifically, projections 67 are positioned facing each other, and are formed close to respective edges of end portions 12 of lateral walls 11 adjacent to shell 13. End portions 12 of lateral walls 11 flex slightly when pins 66 engage respective projections 67.

Figure 2:
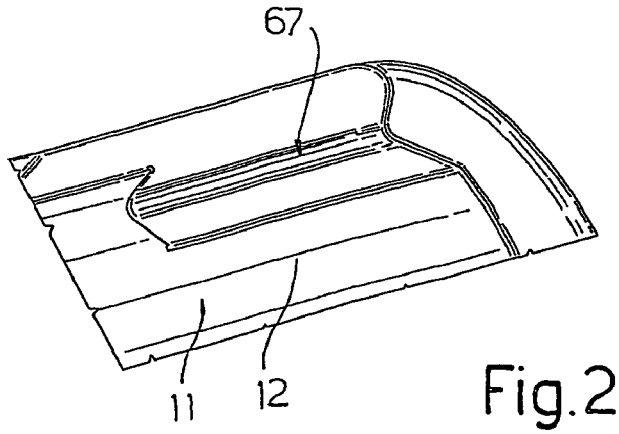
FIG. 2 shows a larger-scale view in perspective of a detail of the FIG. 1 electric plug connector.

Each projection 67 (FIG. 2) has a substantially isosceles-triangle-shaped profile to permit engagement and release by relative pin 66 of lever 30.

In the second closed position of lever 30, lances 52 engage respective seats 68 formed on edges 39 of lateral walls 18 of slide 16, between seats 56 and the free ends of lateral walls 18. Lances 52 may therefore assume a first configuration (FIG. 3) engaging seats 56 to define, together with lances 42, the first partly assembled position of slide 16 and, therefore, the raised position of lever 30; and a second configuration (FIG. 6) engaging seats 68 to define, together with teeth 62, the second partly assembled position of slide 16 and, therefore, the second closed position of lever 30.

The first partly assembled position of slide 16 is therefore located between the fully assembled position and the second partly assembled position, and adjacent to the second partly assembled position.

Figure 6:
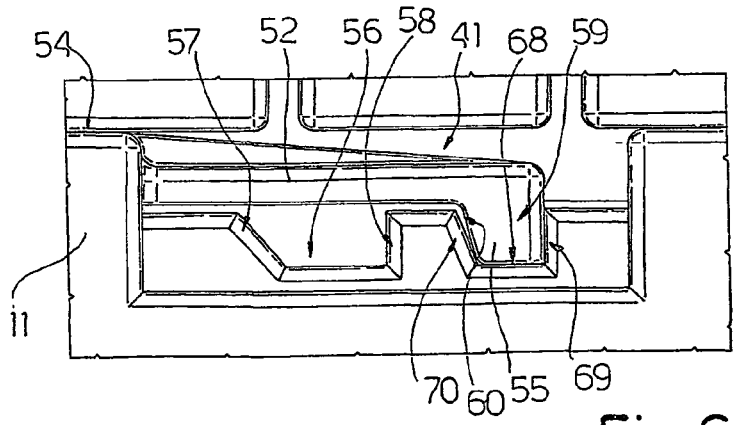
FIG. 6 shows a larger-scale view in perspective of the FIG. 3 detail of the electric plug connector in the FIG. 5 configuration.

As shown clearly in FIG. 6, seats 68 are the same shape as and smaller in direction B than seats 56. More specifically, each seat 68 is defined, towards the free end of relative lateral wall 18, by a straight edge 69 perpendicular to direction B, and, on the opposite side, by an oblique edge 70 sloping, with respect to-direction B, more steeply than edges 57 of seats 56.

Connector 2 is supplied in a deactivated or transit configuration (FIG. 5) in which lever 30 is set to the second closed position on casing 4, and keeps slide 16 in the second partly assembled position or maximum withdrawal position from casing 4.

In this configuration, teeth 62 of arms 31 of lever 30 define stop surfaces for edges 65 of the relative end teeth 38 of racks 37 of slide 16, to prevent slide 16 from moving inwards of main body 6 of casing 4 in direction B; and teeth 55 of lances 52 engage respective seats 68 on lateral walls 18 of slide 16 to prevent further withdrawal of slide 16 from casing 4.

To assemble unit 1, lever 30 must be rotated about axis C from the second closed position to the raised position. When so doing, the free portions 63 of end portions 32 of arms 31 rotate freely with no interference with racks 37 of slide 16 until the first tooth 36 of each sector gear 35 meshes with the first two teeth 38 of rack 37, thus moving slide 16 slightly inwards of main body 6 in direction B.

That is, by virtue of the thrust exerted on slide 16 by lever, and the mutual cooperation of oblique edges 60 and 70, teeth 55 of lances 52 are released from respective seats 68 on lateral walls 18 of slide 16, and click into the adjacent seats 56.

Slide 16 is thus set to the first partly assembled position, in which it is prevented by lances 42 from moving inwards of main body 6, and is prevented by the retaining action of lances 52 from being withdrawn from main body 6.

Lances 42 can only be released from openings 29 in lateral walls 18 of slide 16, and therefore slide 16 fully inserted inside main body 6, by pins 23 on connector 3 correctly engaging relative grooves 22 of slide 16.

More specifically, to fully assemble unit 1, connectors 2 and 3 are engaged in direction A so that pins 23 engage inlet portions 25 of relative grooves 22.

At this stage, the intermediate pins 23 on connector 3 exert thrust on oblique surfaces 51 of teeth 43 of respective lances 42 to rotate lances 42 outwards of main body 6.

As a result, each tooth 43 is positioned with the part defined by straight portion 47 of edge 46 outside respective opening 29, and with the part defined by oblique portion 48 engaging opening 29, so as to allow slide 16 to slide inside main body 6 of case 4 into the fully assembled position.

At this point, lever 30 can be rotated from the raised position in FIG. 1 to the first lowered closed position, thus moving slide 16 by toothed sector 35 engaging rack 37.

As slide 16 is fully inserted inside main body 6, pins 23 slide along oblique intermediate portions 26 of relative grooves 22 to couple connectors 2 and 3 in direction A; and the movement of slide 16 is completed by cross member 34 of lever 30 clicking on to retaining member 61, which corresponds to the final coupled position of connectors 2 and 3.

Figure 8:
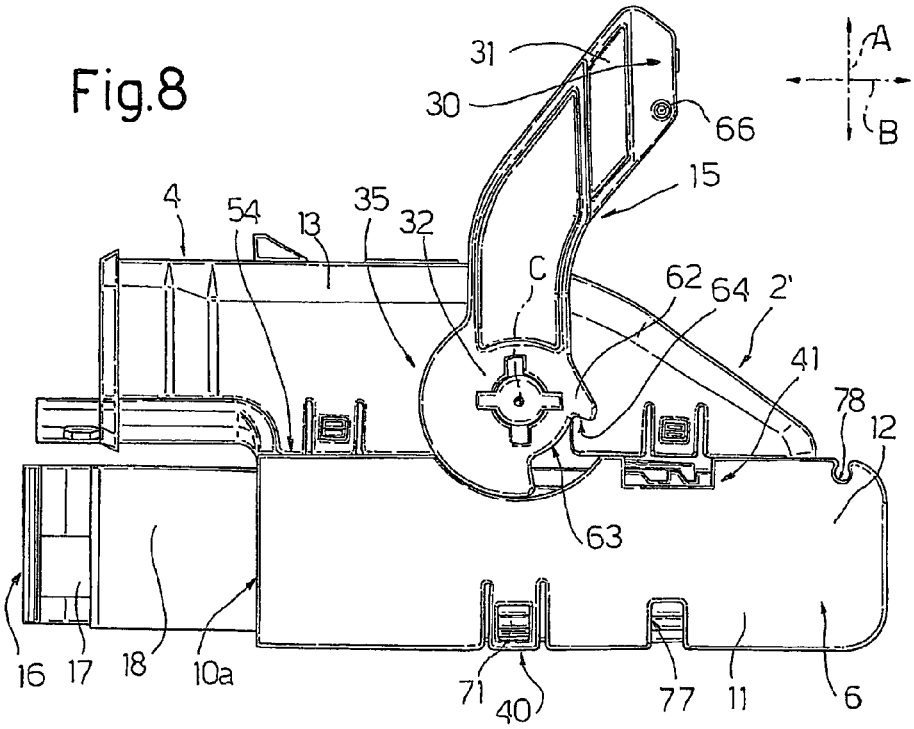
FIG. 8 shows a side view of a further embodiment of an electric plug connector in accordance with the present invention.

FIG. 8 shows a further embodiment of an electric plug connector in accordance with the present invention and indicated as a whole by 2'. In the following description, connector 2' is only described insofar as it differs from connector 2, and using the same reference numbers for parts identical with or corresponding to those already described.

Figure 9:
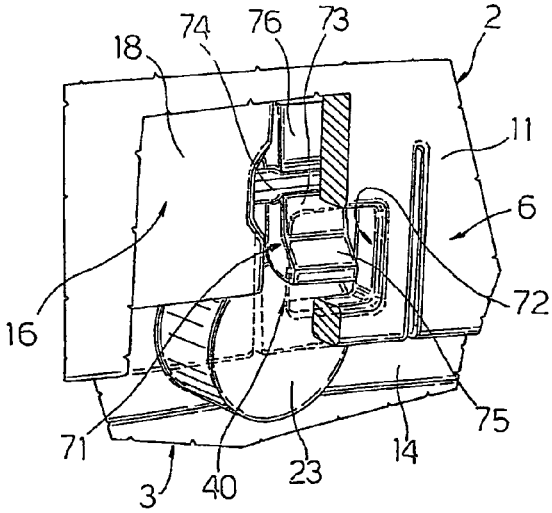
FIG. 9 shows a larger-scale view in perspective of a detail of the FIG. 8 electric plug connector.
Figure 10:
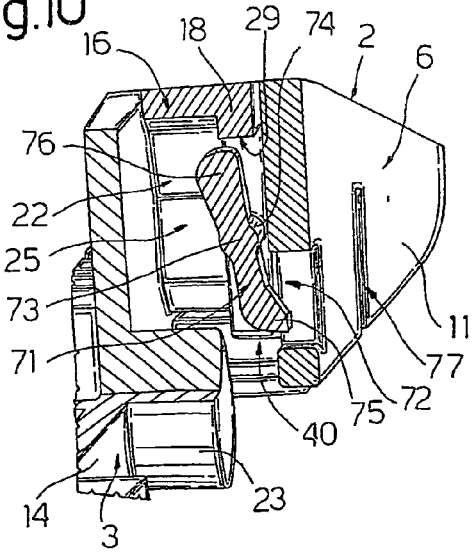
FIG. 10 shows a cross section in perspective of the FIG. 9 detail.

Connector 2' (FIGS. 8 to 10) differs from connector 2 by one-way retaining means 40 comprising, in place of lances 42, two elastically flexible members 71, which project from respective lateral walls 18 of slide 16, engage respective through openings 72 in lateral walls 11 of main body 6, and, when connector 3 is inserted correctly inside the seat on connector 2, are set to a flexed configuration releasing openings 72 and allowing slide 16 to move into the fully assembled position in direction B.

More specifically, each elastically flexible member 71 engages through opening 29 in relative lateral wall 18 of slide 16, and is moved into the flexed configuration by interaction with relative pin 23.

More specifically, each elastically flexible member 71 comprises an intermediate portion 73 connected to relative lateral wall 18 of slide 16 by an elastic hinge 74, and extending though opening 29 in relative lateral wall 18; a first end portion 75 engaging opening 72 in relative lateral wall 11 of main body 6; and an opposite second end portion 76 projecting inside inlet portion 25 of relative groove 22.

In the example shown, each elastic hinge 74 is defined by a pin made of plastic material, having an axis parallel to direction B, and fixed at the ends to opposite lateral edges of opening 29 of relative groove 22.

Once inserted inside inlet portions 25 of relative intermediate grooves 22, pins 23 act on end portions 76 of relative elastically flexible members 71 to rotate the elastically flexible members about hinges 74 and so release end portions 75 of elastically flexible members 71 from openings 72 in main body 6 of casing 4.

Connector 2' also differs from connector 2 by the fully assembled position of slide 16 being defined by end portions 75 of elastically flexible members 71 clicking inside respective through openings 77 formed in lateral walls 11 of main body 6 and spaced apart from relative openings 72.

Connector 2' also differs from connector 2 by the second closed position of lever 30 on casing 4 being defined by pins 66 engaging respective U-shaped recesses 78 formed on the edges of end portions 12 of lateral walls 11 adjacent to shell 13.

Connector 2' is fitted to connector 3 in exactly the same way as described with reference to connector 2.

The only substantial difference lies in the way in which pins 23 act on elastically flexible members 71. More specifically, when inserted inside inlet portions 25 of relative grooves 22, the intermediate pins 23 on connector 3 exert thrust on end portions 76 of respective elastically flexible members 71 to rotate the elastically flexible members clockwise, in FIG. 10, about hinges 74.

As a result, end portion 75 of each elastically flexible member 71 is released from relative opening 72 in main body 6 of casing 4 to allow slide 16 to slide in direction B and, therefore, operation of lever 30 to couple connectors 2 and 3.

The movement of slide 16 is completed by end portions 75 of elastically flexible members 71 clicking inside respective openings 77 in main body 6, which corresponds to the final coupled position of connectors 2 and 3.

The advantages of connectors 2 and 2' in accordance with the teachings of the present invention will be clear from the foregoing description.

In particular, by virtue of the retaining action of one-way retaining means 40, slide 16 can only be moved inwards of main body 6 of casing 4 by lances 42 or elastically flexible members 71 interacting with pins 23 correctly inserted inside inlets 25 of relative grooves 22.

In the second closed position of lever 30, teeth 62 define additional stop surfaces for slide 16 in the insertion direction inside main body 6 of casing 4, thus preventing any movement of slide 16 in the event of impact or other accidental causes. Moreover, retention of lever 30 in the second closed position on casing 4 by pins 66 engaging end portions 12 of lateral walls 11 of main body 6 ensures firm retention of the whole defined by lever 30 and slide 16.

Nor does increasing the retaining load on slide 16 in the second partly assembled position increase the manual effort required on lever 30 to couple connectors 2 and 3, in that, before coupling can commence, lever 30 must first be reset to the raised position engaging slide 16.

Free portions 63 on end portions 32 of arms 31 of lever 30 provide for disconnecting lever 30 and slide 16, which, in addition to moving lever 30 between the raised and second closed positions without interacting with slide 16 so as to limit the displacement thereof between the first and second partly assembled position, can also be used to insert slide 16 inside casing 4 after assembling lever 30.

Finally, by virtue of the combined action of one-way retaining means 40 and 41, lever 30, together with slide 16, can be set to a precise position (FIG. 1) to receive connector 3.

Clearly, changes may be made to connectors 2, 2' as described and illustrated herein without, however, departing from the scope of the present invention.

The invention claimed is:

1. An electric connector comprising an insulating casing defining a number of cavities for housing respective electric terminals and having axes parallel to a first direction in which said connector is coupled to a complementary connector; a slide fitted to said casing to slide in a second direction perpendicular to said first direction, and having cam-type first engaging members for receiving respective second engaging members on said complementary connector to produce a relative coupling movement of said connectors in said first direction when said slide is moved in said second direction into a fully assembled position with respect to said casing; and releasable constraint means for keeping said slide partly connected to said casing; characterized in that said releasable constraint means comprise retaining means for locking said slide to said casing in at least two stationary positions; at least one of said retaining means being selectively deactivated by said complementary connector when coupling said connector to said complementary connector, wherein said retaining means comprises a first retainer for locking said slide in a first one of the stationary positions and a second different retainer for locking said slide in a second one of the stationary positions, wherein the first retainer is spaced from the second retainer.

2. A connector as claimed in claim 1, characterized by comprising an actuating lever connected movably to said casing to move said slide into said fully assembled position.

3. A connector as claimed in claim 2 characterized in that said retaining means comprise releasable one-way stop means acting on said slide to prevent the slide from moving into said fully assembled position, and defined by said lever in a deactivated position.

4. A connector as claimed in claim 3, characterized in that said stop means comprise a stop tooth projecting radially from said hinge portion of said lever, and defining a stop surface for a rack of the lever on said slide when said lever is in said deactivated position; and in that said free portion of said hinge portion of said lever is defined on opposite sides by a sector gear of the lever and said stop tooth.

5. A connector as claimed in claim 1, characterized in that said retaining means comprise elastically flexible oneway locking means which interfere with the sliding movement of said slide into said fully assembled position, and which are set by correct engagement of said first and said second engaging members to a deformed configuration allowing said slide to move into said fully assembled position.

6. A connector as claimed in claim 5, characterized in that said first engaging members comprise a number of cam grooves formed on said slide; and in that said locking means extend through at least one of said grooves, and are set to said deformed configuration by interacting with a relative one of said second engaging members on said complementary connector engaging said one of said grooves.

7. A connector as claimed in claim 6, characterized in that said locking means comprise at least one elastically flexible member, which is carried by one of said casing and said slide, has an interference portion interfering with the other of said casing and said slide, and is activated by a relative one of said second engaging members on said complementary connector engaging said one of said grooves.

8. A connector as claimed in claim 7, characterized in that said elastically flexible member projects from a wall of said casing, and comprises an end tooth defining said interference portion, and which engages an inlet portion of said one of said grooves, and is released from said inlet portion by interacting with the relative one of said second engaging members engaging said one of said grooves.

9. A connector as claimed in claim 7, characterized in that said elastically flexible member projects from said slide, cooperates with an interacting portion of said casing to prevent said slide from moving into said fully assembled position, and is releasable from said interacting portion in said deformed configuration.

10. A connector as claimed in claim 9, characterized in that said interacting portion is defined by a through opening formed in said casing and engaged by said elastically flexible member.

11. A connector as claimed in claim 5, characterized in that said retaining means comprise second releasable one-way locking means exerting on said slide retaining forces opposite those exerted by said stop means a and said locking means, to prevent withdrawal of the slide from said casing.

12. A connector as claimed in claim 11, characterized in that said second locking means can be set to a first and a second operating configuration; wherein said second locking means, when in said first operating configuration, and said locking means temporarily retaining said slide in said first partly assembled position and retaining a lever in a first operating position; wherein said second locking means, when in said second operating configuration, and said stop means temporarily retaining said slide in a second partly assembled position with respect to said casing corresponding to a deactivated position of said lever; and wherein said first partly assembled position of said slide being a position interposed, in said second direction, between said second partly assembled position and said fully assembled position.

13. A connector as claimed in claim 12, characterized in that said second locking means comprise at least one elastic lance carried by one of said casing and said slide; and further comprising two seats formed on the other of said casing and said slide, and which are located successively in said second direction, and wherein the seats are engaged by said lance to respectively define said first and second partly assembled position of said slide.

14. A connector as claimed in claim 1, characterized in that said retaining means, define a first and a second partly assembled position of said slide with respect to said casing; said first partly assembled position of said slide being a position interposed, in said second direction, between said second partly assembled position and said fully assembled position.

15. An electric connector comprising:

an insulating casing defining a number of cavities for housing respective electric terminals and having axes parallel to a first direction in which said connector is coupled to a complementary connector;

a slide fitted to said casing to slide in a second direction perpendicular to said first direction, and having cam-type first engaging members for receiving respective second engaging members on said complementary connector to produce a relative coupling movement of said connectors in said first direction when said slide is moved in said second direction into a fully assembled position with respect to said casing; and an actuating lever connected movably to said casing to move said slide into said fully assembled position, characterized in that said lever comprises at least one hinge portion hinging it to said casing about an axis perpendicular to said first and said second direction; and in that said hinge portion comprises, with reference to said axis, an angular coupling portion for engaging said slide, and a free angular portion for releasing the slide.

16. A connector as claimed in claim 15, characterized in that said coupling portion of said hinge portion of said lever comprises a sector gear meshing with a rack on said slide; and in that said free portion of said hinge portion of said lever is movable clear of the profile of said rack on said slide.

17. A connector as claimed in claim 16 characterized in that said sector gear meshes with said rack as said lever is rotated between a first and a second operating position corresponding respectively to a first partly assembled position of said slide with respect to said casing and to said fully assembled position; and in that said free portion passes clear of said rack as said lever is rotated between said first operating position and said deactivated position.

18. A connector as claimed in claim 17, characterized by comprising rigid connecting means for rigidly connecting said lever to said casing in said deactivated position; said rigid connecting means being selectively releasable to move said lever into said first operating position.

19. A connector as claimed in claim 18, characterized in that said rigid connecting means comprise fastening means for fastening said lever to said casing.

20. A connector as claimed in claim 15 further comprising releasable constraint means for keeping said slide partly connected to said casing, wherein said releasable constraint means comprise retaining means for locking said slide to said casing in at least two stationary positions, characterized in that said retaining means comprise releasable one-way stop means acting on said slide to prevent the slide from moving into said fully assembled position, wherein said releasable one-way stop means is defined by said lever in a deactivated position.

21. An electric connector comprising an insulating casing defining a number of cavities for housing respective electric terminals and having axes parallel to a first direction in which said connector is coupled to a complementary connector; a slide fitted to said casing to slide in a second direction perpendicular to said first direction, and having cam-type first engaging members for receiving respective second engaging members on said complementary connector to produce a relative coupling movement of said connectors in said first direction when said slide is moved in said second direction into a fully assembled position with respect to said casing; and releasable constraint means for keeping said slide partly connected to said casing; characterized in that said releasable constraint means comprise retaining means for locking said slide to said casing; said retaining means being selectively deactivated when coupling said connector to said complementary connector, characterized in that said retaining means comprise elastically flexible oneway locking means which interfere with the sliding movement of said slide into said fully assembled position, and which are set by correct engagement of said first and said second engaging members to a deformed configuration allowing said slide to move into said fully assembled position, characterized in that said first engaging members comprise a number of cam grooves formed on said slide; and in that said locking means extend through at least one of said grooves, and are set to said deformed configuration by interacting with a relative one of said second engaging members on said complementary connector engaging said one of said grooves, characterized in that said locking means comprise at least one elastically flexible member, which is carried by one of said casing and said slide, has an interference portion interfering with the other of said casing and said slide, and is activated by a relative one of said second engaging members on said complementary connector engaging said one of said grooves, characterized in that said elastically flexible member projects from said slide, cooperates with an interacting portion of said casing to prevent said slide from moving into said fully assembled position, and is releasable from said interacting portion in said deformed configuration, characterized in that said interacting portion is defined by a through opening formed in said casing and engaged by said elastically flexible member, characterized in that said elastically flexible member comprises an intermediate portion connected to said slide by an elastic hinge; a first end portion engaging said opening in said casing; and an opposite second end portion which projects through an inlet portion of said one of said grooves.

22. An electric connector comprising:

an insulating casing defining cavities for housing electric terminals and having axes parallel to a first direction in which the connector is coupled to a complementary connector;

a slide fitted to the casing to slide in a second direction perpendicular to the first direction, wherein the slide comprises cam-type first engaging areas for receiving respective second engaging areas on the complementary connector to produce a relative coupling movement of the connectors in the first direction when the slide is moved in the second direction into a fully assembled position with respect to the casing; and a releasable constraint system for keeping the slide partly connected to the casing, wherein the releasable constraint system comprises retainers for locking the slide to the casing in at least two stationary positions, wherein at least one of the retainers is selectively deactivated by the complementary connector when coupling the connector to the complementary connector, wherein the retainers comprises a first retainer for locking the slide in a first one of the stationary positions and a second different retainer for locking the slide in a second one of the stationary positions.

* * * * *